US012631169B2

(12) United States Patent
Kim et al.

(10) Patent No.: US 12,631,169 B2
(45) Date of Patent: May 19, 2026

(54) RECIPROCATING COMPRESSOR

(71) Applicant: LG ELECTRONICS INC., Seoul (KR)

(72) Inventors: Younghwan Kim, Seoul (KR); Jinkook Kim, Seoul (KR); Jongmok Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 106 days.

(21) Appl. No.: 18/702,208

(22) PCT Filed: Jun. 29, 2022

(86) PCT No.: PCT/KR2022/009336
§ 371 (c)(1),
(2) Date: Apr. 17, 2024

(87) PCT Pub. No.: WO2023/080381
PCT Pub. Date: May 11, 2023

(65) Prior Publication Data

US 2024/0418158 A1 Dec. 19, 2024

(30) Foreign Application Priority Data

Nov. 3, 2021 (KR) ..... 10-2021-0149323

(51) Int. Cl.
*F04B 39/02* (2006.01)

(52) U.S. Cl.
CPC ..... *F04B 39/0253* (2013.01); *F04B 39/0246* (2013.01)

(58) Field of Classification Search
CPC ..... F04B 39/0246; F04B 39/0253
See application file for complete search history.

(56) References Cited

U.S. PATENT DOCUMENTS 2,766,929 A * 10/1956 Rusch ..... F04B 39/0253 417/372
3,253,776 A * 5/1966 Parker ..... F25B 31/002 417/372

(Continued)

FOREIGN PATENT DOCUMENTS

CN 203051043 7/2013
KR 20-0149015 6/1999

(Continued)

OTHER PUBLICATIONS

Machine Translation of KR 20070010520.*

(Continued)

*Primary Examiner* — Christopher S Bobish
(74) *Attorney, Agent, or Firm* — KED & ASSOCIATES

(57) ABSTRACT

A reciprocating compressor including a crankshaft including a shaft portion, an eccentric mass portion, and a pin portion, and an oil groove positioned on an outer surface of the pin portion configured to supply oil to a pressurized portion of a bearing immediately before entering a section in which a gas load increases. For example, the oil groove may supply the oil to the bearing in a stroke section immediately before a crank angle reaches 270°. Accordingly, lubrication by the oil may be smoothly performed in the stroke section subjected to a high load, and oil shortage may be improved even if the oil groove adopts a structure in which the bearing is open at the top and bottom.

18 Claims, 13 Drawing Sheets

(56) References Cited

U.S. PATENT DOCUMENTS

| | | | | | |
|---|---|---|---|---|---|
| 3,276,677 | A * | 10/1966 | Trask | F16C 33/1065 | 415/72 |
| 4,236,879 | A * | 12/1980 | Abe | F04B 39/0246 | 417/372 |
| 4,325,679 | A * | 4/1982 | Smith | F04B 39/0246 | 417/372 |
| 7,367,784 | B2 * | 5/2008 | No | F04B 39/0261 | 417/372 |
| 7,993,114 | B2 * | 8/2011 | Hayashi | F04B 39/0253 | 184/6.5 |
| 8,740,585 | B2 * | 6/2014 | Park | F04B 39/023 | 417/415 |
| 8,978,826 | B2 * | 3/2015 | Kim | F04B 39/0253 | 417/372 |
| 10,378,527 | B2 * | 8/2019 | Kim | F04B 39/0253 | |
| 2007/0025864 | A1 * | 2/2007 | Cho | F04B 39/0253 | 417/415 |
| 2014/0010685 | A1 * | 1/2014 | Kita | F04B 53/18 | 417/415 |
| 2017/0114782 | A1 * | 4/2017 | Manke | F04B 39/123 | |

FOREIGN PATENT DOCUMENTS

| | | |
|---|---|---|
| KR | 10-1999-0057040 | 7/1999 |
| KR | 10-2002-0019225 | 3/2002 |
| KR | 10-2002-0040296 | 5/2002 |
| KR | 10-2007-0010520 | 1/2007 |

OTHER PUBLICATIONS

Machine Translation of KR 10-2002-0040296.*
International Search Report dated Feb. 6, 2023 issued in Application No. PCT/KR2022/009336.

* cited by examiner

【FIG. 1】
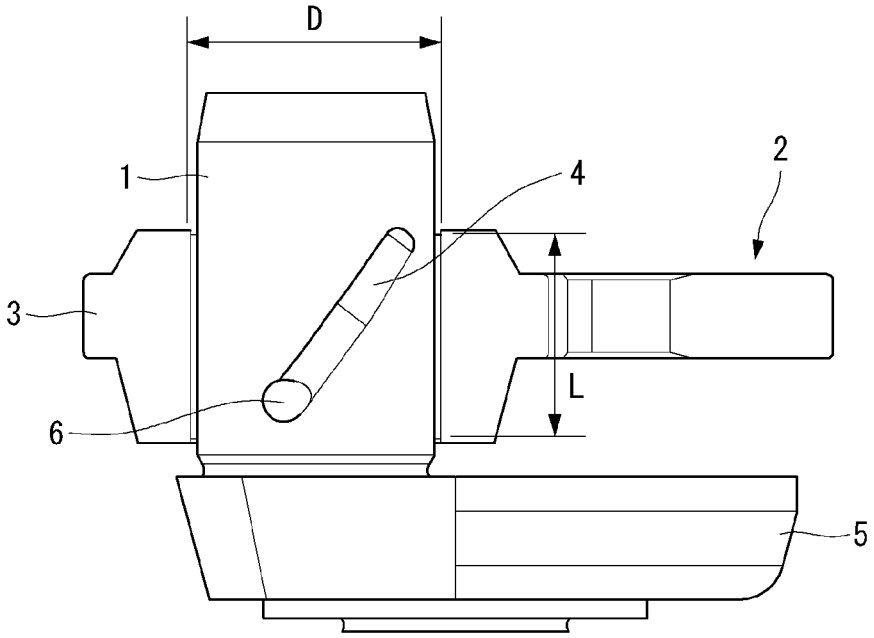

【FIG. 2】
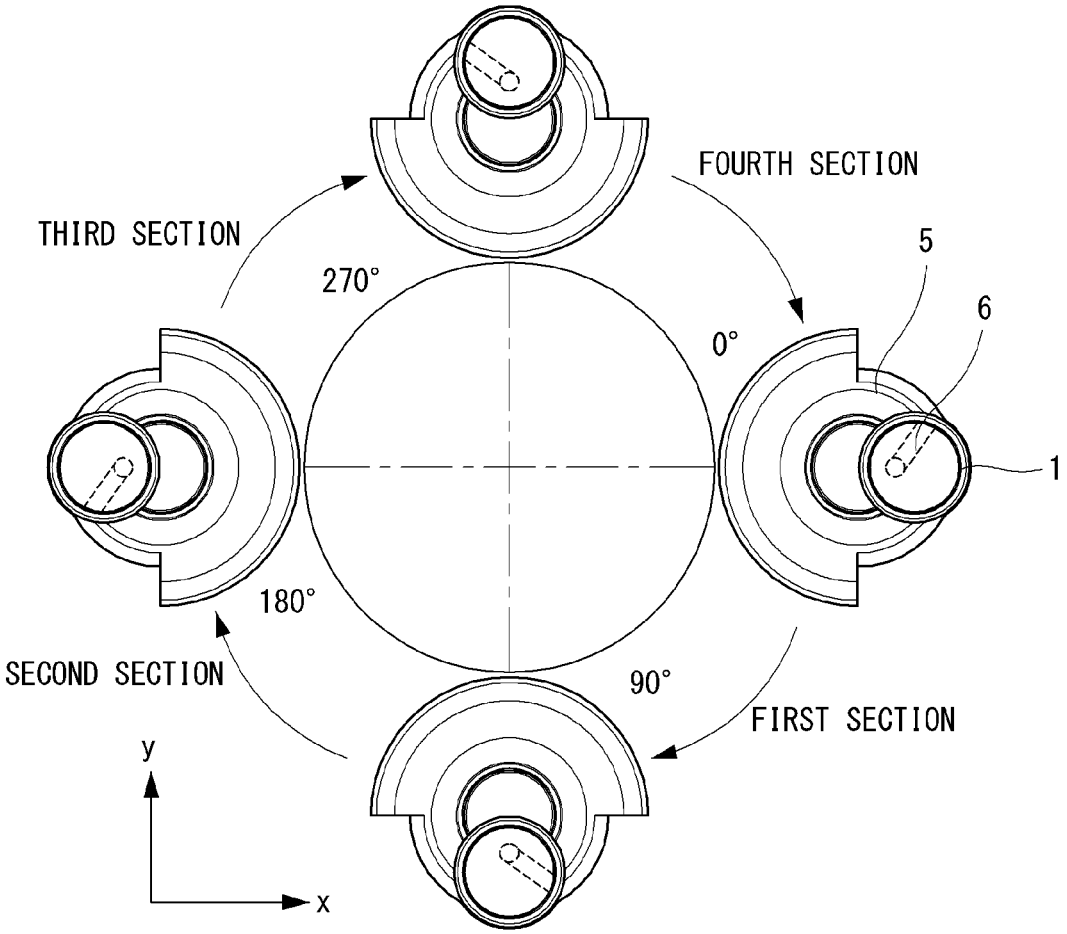

【FIG. 3】
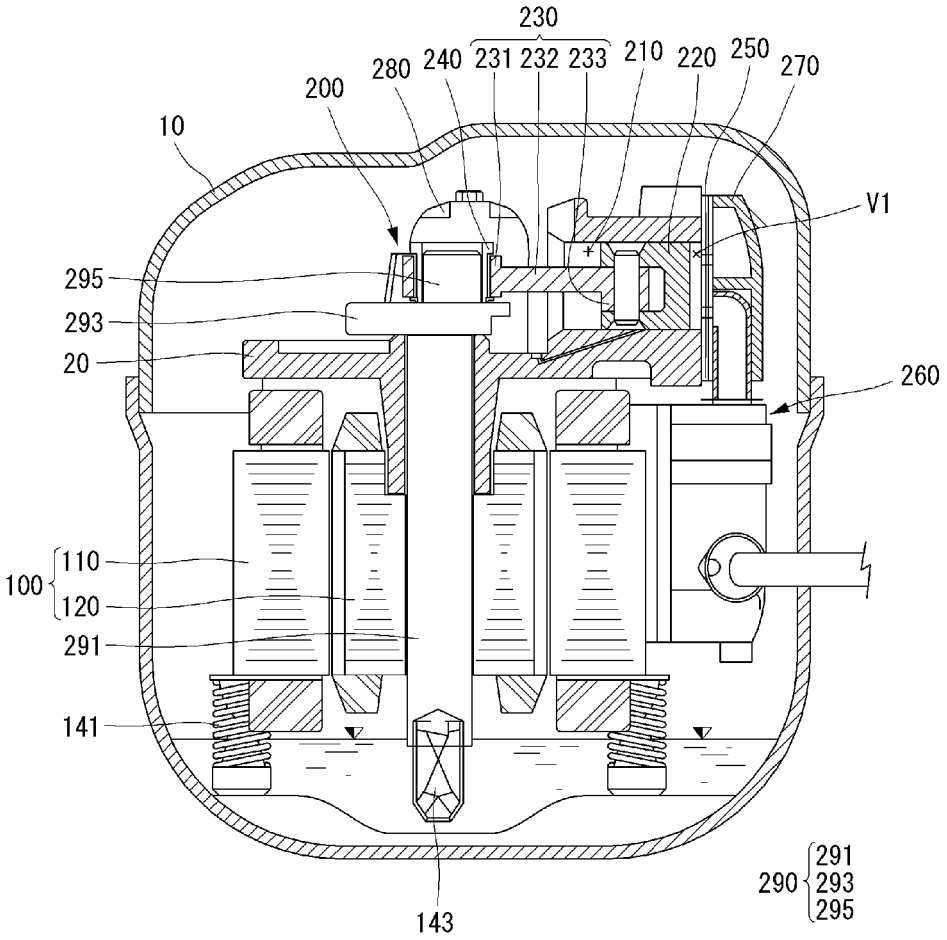

【FIG. 4】
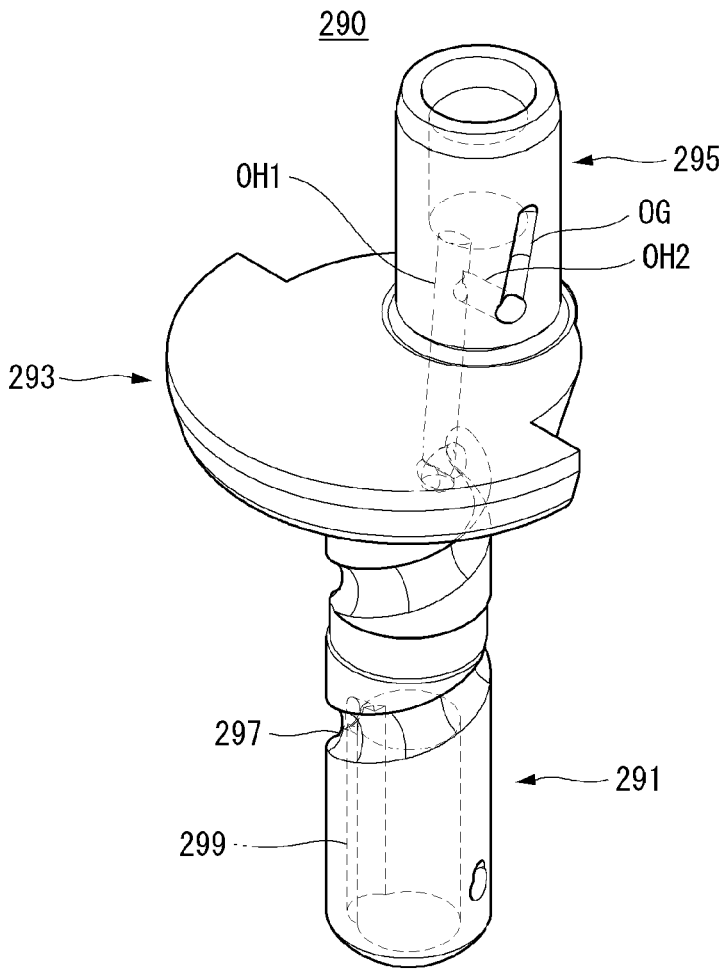

【FIG. 5】
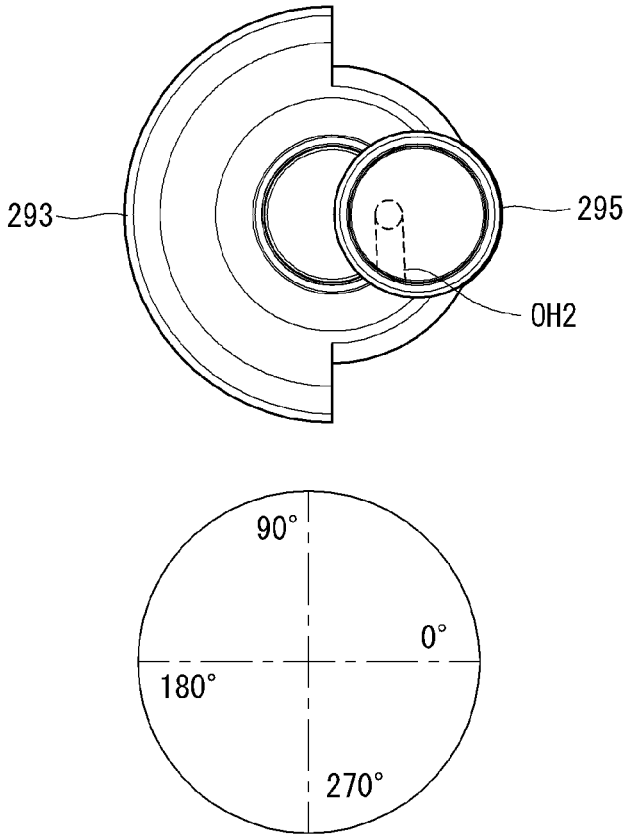
Bearing angle at top dead center

【FIG. 6】
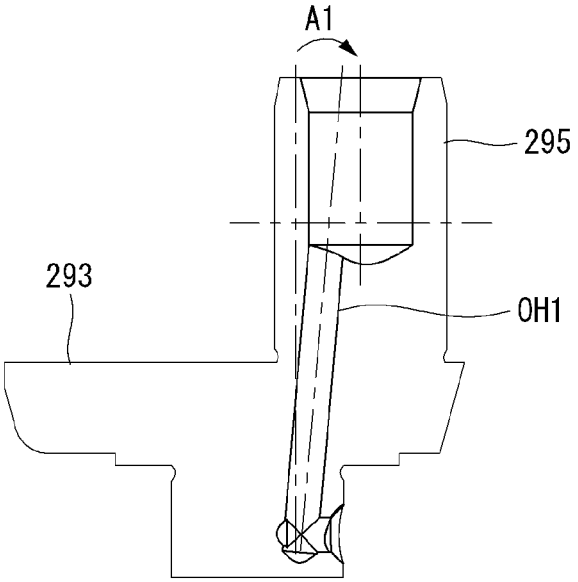
【FIG. 7】
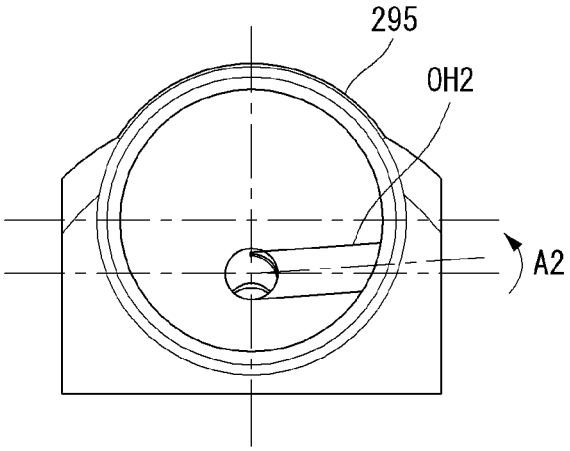

【FIG. 8】
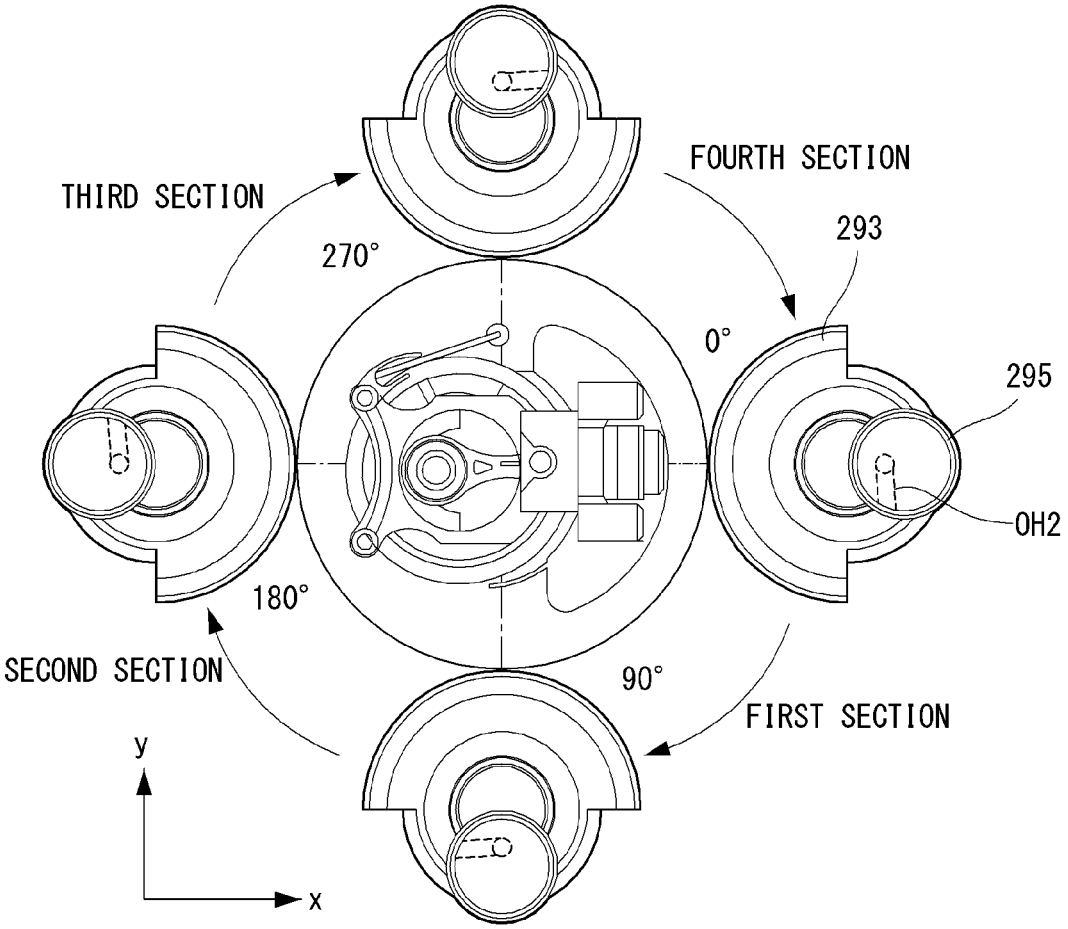

【FIG. 9】
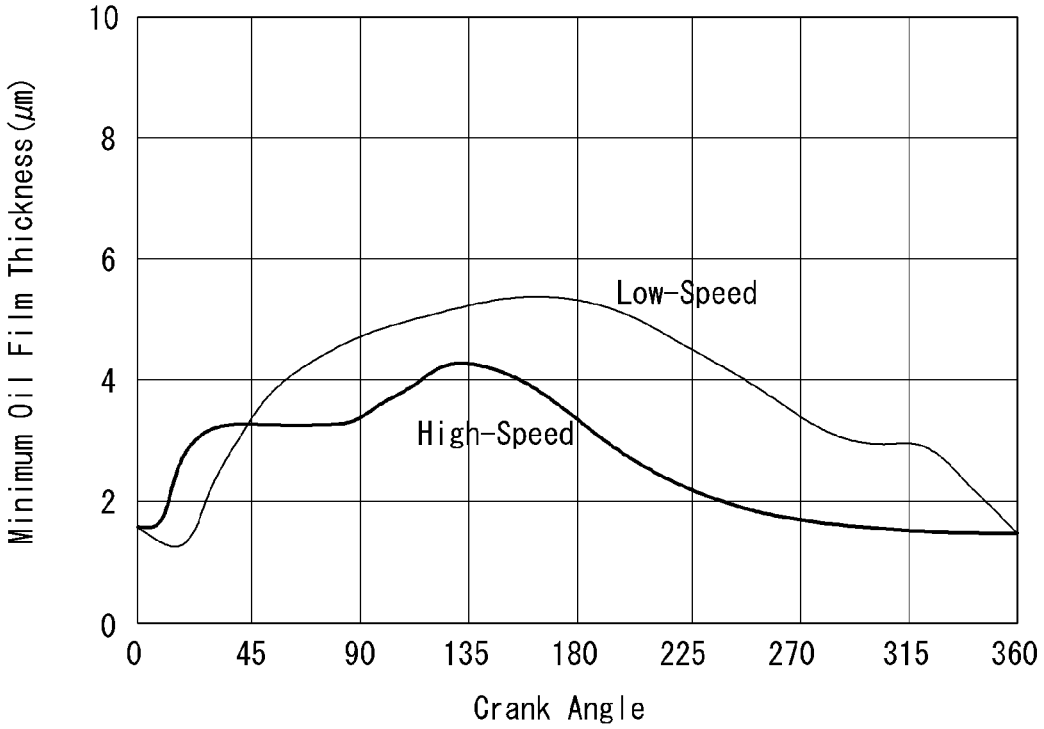

【FIG. 10】
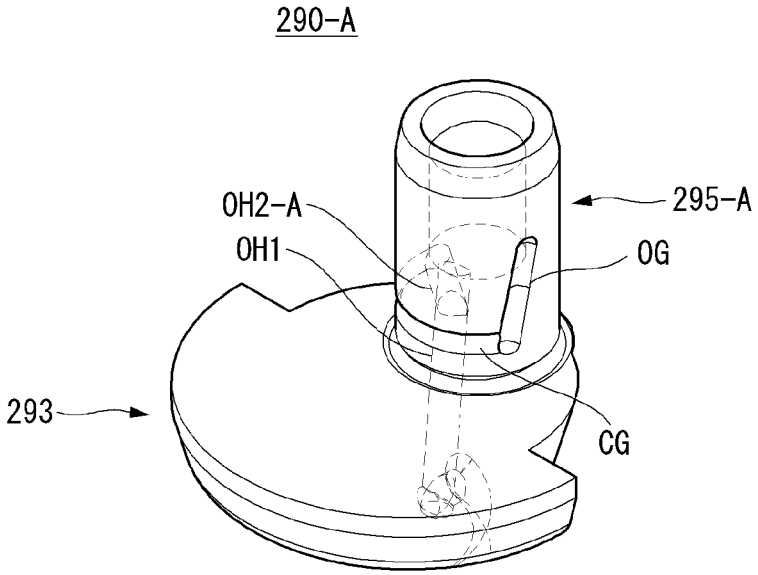
【FIG. 11】
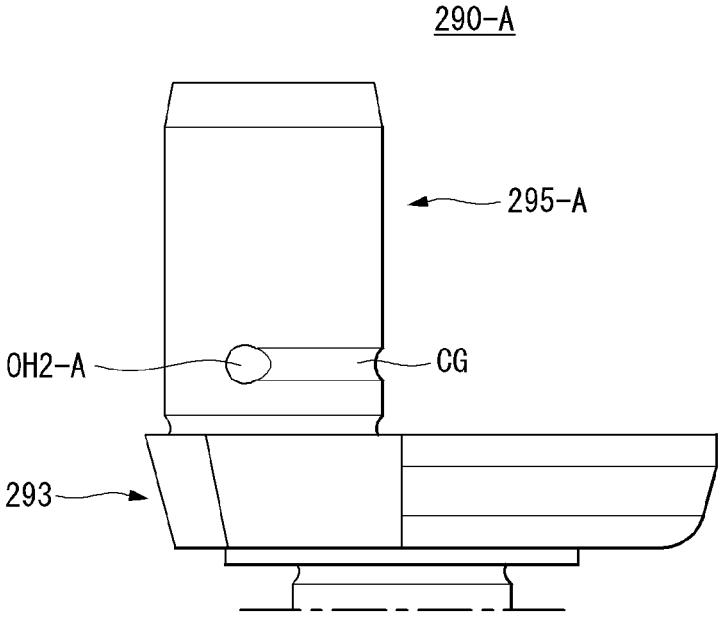

【FIG. 12】
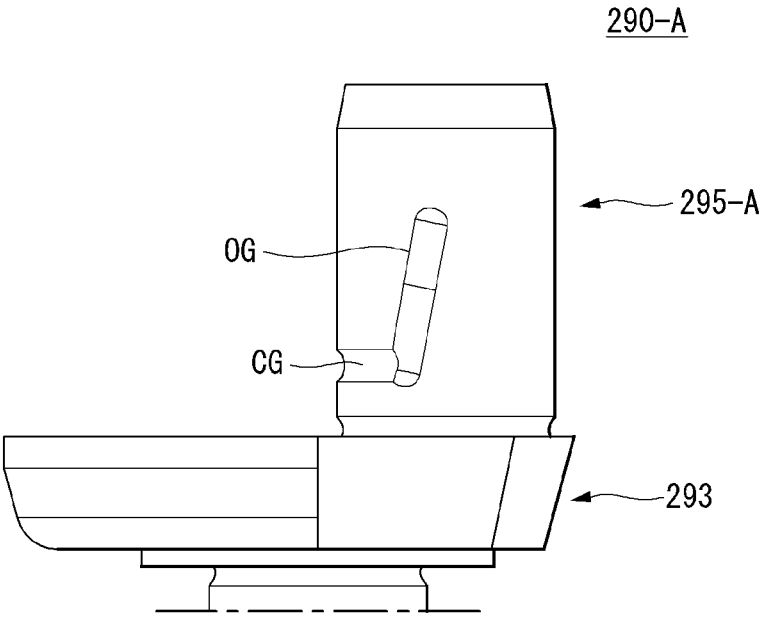
【FIG. 13】
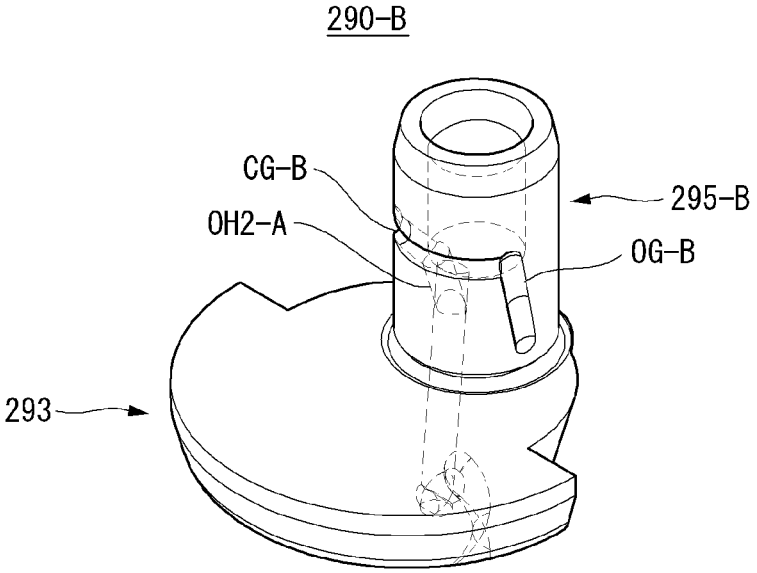

【FIG. 14】
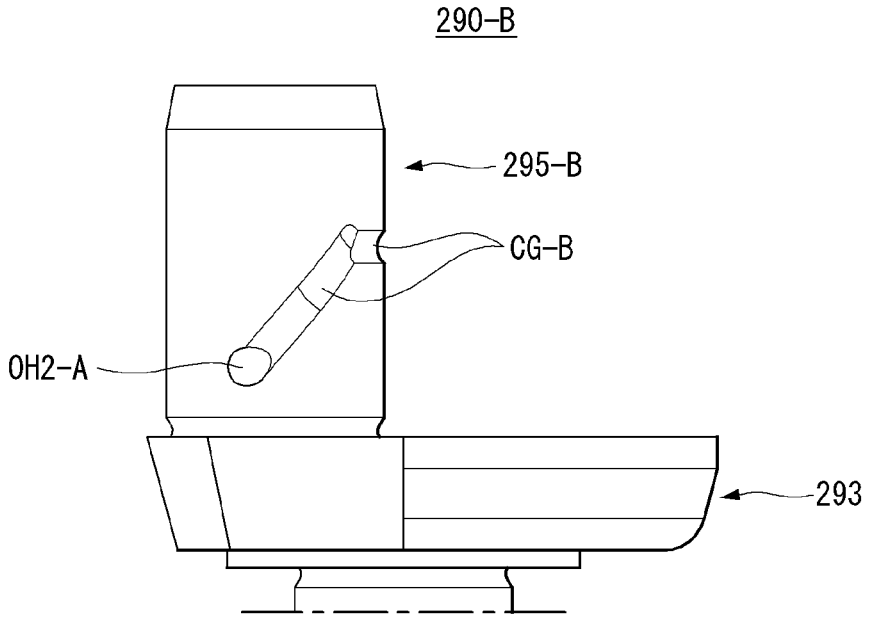
【FIG. 15】
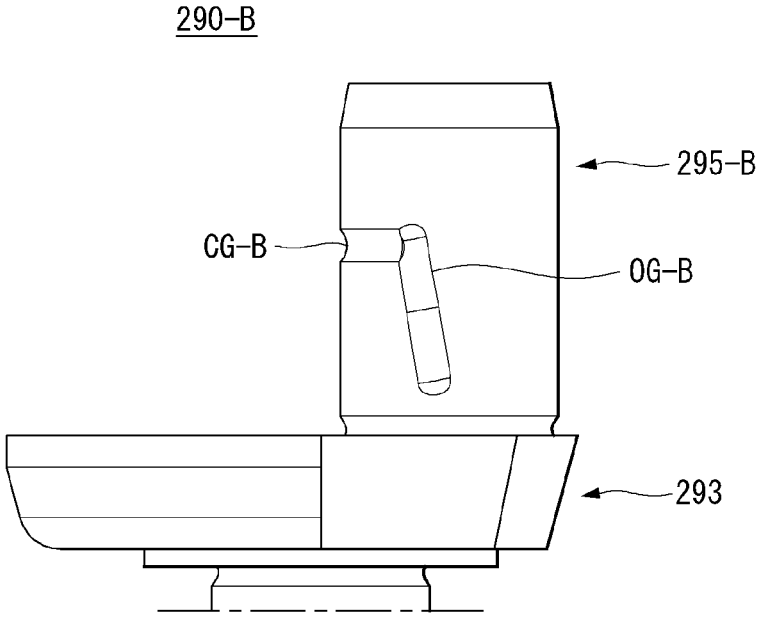

【FIG. 16】
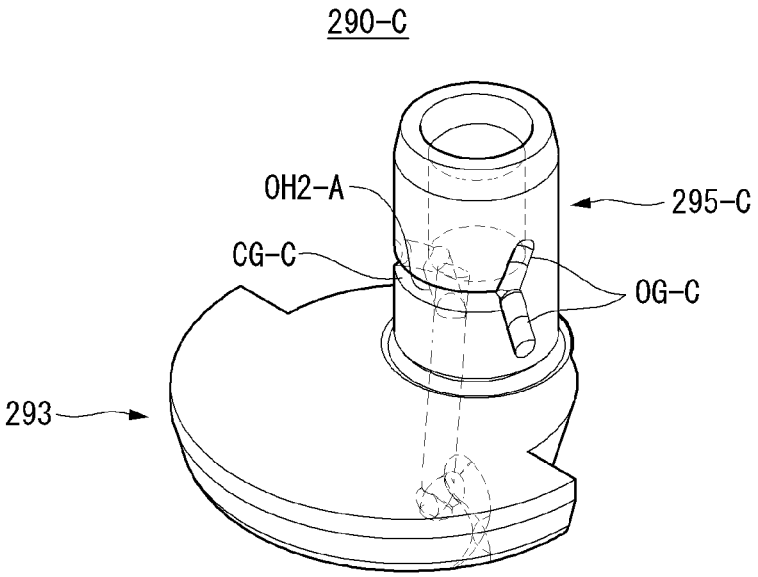
【FIG. 17】
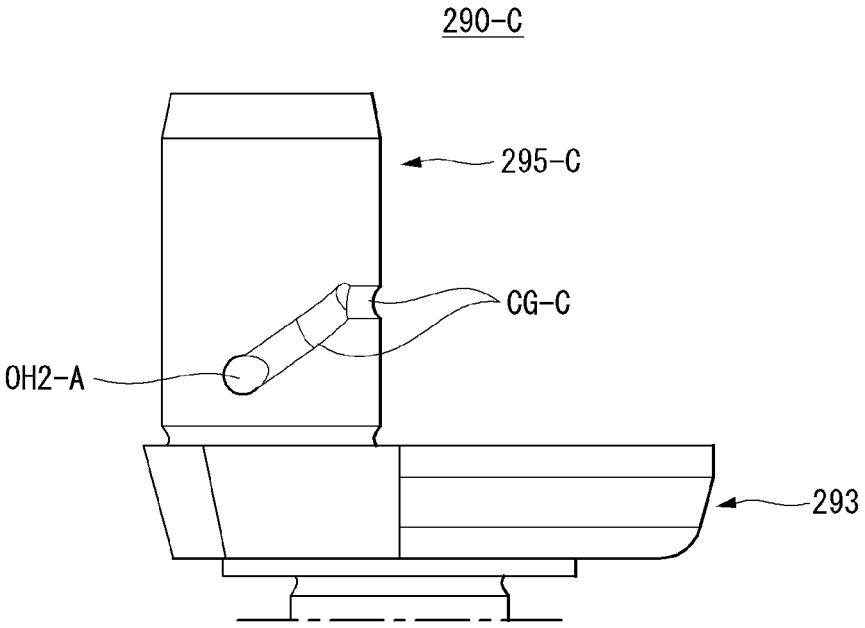

【FIG. 18】
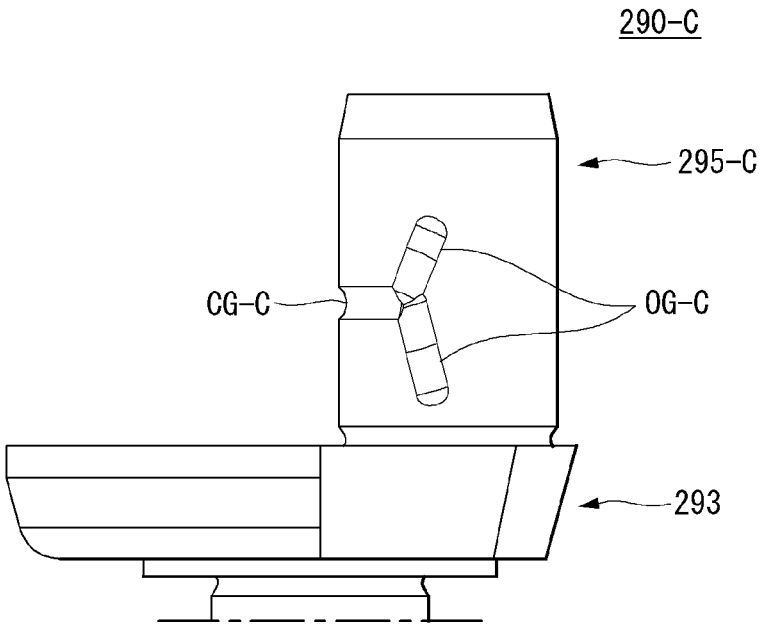

RECIPROCATING COMPRESSOR

TECHNICAL FIELD

The present disclosure relates to a reciprocating compressor, and more particularly to a reciprocating compressor that minimizes oil leakage and wear generated in a crank pin portion.

BACKGROUND ART

A reciprocating compressor is a compressor in which a piston suctions, compresses, and discharges a refrigerant while linearly reciprocating in a cylinder.

The reciprocating compressor may be classified into a connected type reciprocating compressor and a vibration type reciprocating compressor based on a driving method of the piston.

The connected type reciprocating compressor compresses a refrigerant while a piston connected to a crank pin through a connecting rod reciprocates in a cylinder, and the crank pin is provided on a crankshaft that is coupled to a rotor of a rotating motor and transmits a rotational force. The vibration type reciprocating compressor compresses a refrigerant while a piston connected to a mover of a reciprocating motor vibrates and reciprocates in a cylinder.

The reciprocating compressor includes a sealed container with a sealed space, an electric drive unit that is installed in the sealed container to generate a rotational force, and a compression unit that is installed on an upper side of the electric drive unit to receive the rotational force of the electric drive unit and compress a refrigerant.

The compression unit includes a cylinder block that includes a cylinder forming a compression space and is elastically supported in the sealed container, a crankshaft that is inserted into the cylinder block, is supported radially and axially, and is coupled to a rotor of the electric drive unit to transmit a rotational force, a connecting rod that is rotatably coupled to the crankshaft and converts a rotational motion into a linear motion, and a piston that is rotatably coupled to the connecting rod and compresses the refrigerant while linearly reciprocating in the cylinder.

The crankshaft includes a shaft portion that is coupled to the rotor, is inserted into the cylinder block, and is radially supported by the cylinder block, an eccentric mass portion that is eccentrically formed in a fan shape or an eccentric circular flange shape at an upper end of the shaft portion to form a plate-shaped extension, and a pin portion which is formed eccentrically with respect to the shaft portion at an upper surface of the eccentric mass portion and into which the connecting rod is rotatably inserted.

The reciprocating compressor thus configured requires the supply of oil for lubrication or cooling of the compression unit and the electric drive unit.

Accordingly, oil for lubrication and cooling of the electric drive unit and the compression unit is stored at the bottom of the sealed container, and an oil passage is formed in the crankshaft to suck the oil and supply the oil to the inside of the piston and the cylinder by a centrifugal force when the crankshaft rotates.

The oil passage includes a first oil hole penetrating the shaft portion and the pin portion, a second oil hole that is connected to the first oil hole and is formed toward an outer surface of the pin portion, and an oil groove that is formed on the outer surface of the pin portion and is connected to the second oil hole.

The oil groove is positioned to avoid an area, in which a bearing dynamic pressure occurs, in order to increase a bearing support force.

The first oil hole and the second oil hole are designed to increase the centrifugal force, and the oil groove is designed to comply with a direction of rotation.

In order to satisfy these conditions, when the pin portion rotates clockwise, the oil groove is formed on a right outer surface of the pin portion when viewing the pin portion from the piston side in a state where the piston is positioned at top dead center, that is, a crank angle is 0°.

FIG. 1 illustrates a crank pin portion in a crankshaft according to a related art when a piston is positioned at bottom dead center, that is, a crank angle is 180°.

Referring to FIG. 1, a pin connector 3 of a connecting rod 2 is connected to a pin portion 1 of a crankshaft, and an oil groove 4 is formed on an outer surface of the pin portion 1 so that it is in a section that allows a bearing angle to be 0° to 180°, for example, 50° to 150°. In FIG. 1, a reference numeral 5 denotes an eccentric mass portion of the crankshaft.

When the bearing angle is 0° at a crank angle of 0°, and the bearing angle changes up to 360° in a counterclockwise direction which is the opposite direction of the crank angle, the oil groove 4 is positioned in the section in which the bearing angle is 50° to 150°.

Accordingly, as illustrated in FIG. 2, in a first section in which the pin portion 1 rotates clockwise in a state where the piston is positioned at top dead center, that is, until a crank angle reaches from 0° to 90°, oil is supplied to a bearing through a second oil hole 6 and the oil groove 4. In a second section in which the pin portion 1 rotates clockwise until the crank angle reaches from 90° to 180°, and a third section in which the pin portion 1 rotates clockwise until the crank angle reaches from 180° to 270°, the oil supplied through the second oil hole 6 and the oil groove 4 is not used to lubricate a pressurized portion of the bearing and leaks. In a fourth section in which the pin portion 1 rotates clockwise until the crank angle reaches from 270° to 360° (or 0°), the gas load increases.

As above, when the oil groove 4 is positioned in the section in which the bearing angle is 50° to 150°, the oil is supplied to the bearing while the piston descends after passing top dead center. Therefore, lubrication of the pressurized portion of the bearing is not effectively performed.

An existing example where the oil groove is formed at locations illustrated in FIGS. 1 and 2 is disclosed in Chinese Patent No. CN 203051043U (hereinafter referred to as "prior patent").

FIG. 2 illustrates an example where a pin portion eccentrically rotates clockwise around a shaft portion. However, when viewing along an inclined direction of an oil groove, the prior patent illustrates an example where the pin portion rotates counterclockwise.

Accordingly, as described in FIGS. 1 and 2 and the prior patent, if an oil groove 1 is formed in a section in which a bearing angle is 50° to 150°, the oil groove 1 does not affect generation of a bearing dynamic pressure, and thus there is an effect of improving a bearing support force.

However, in the above-described structure, since oil is supplied to the bearing in a section with low load, for example, the first section, at least a part of the oil supplied to the bearing through the oil groove 1 does not remain in the bearing and leaks in the second section and the third section before entering a section with high load, for example, the fourth section.

Accordingly, in the fourth section which is a section where the gas load increases, there is a possibility that the bearing may wear out due to insufficient oil in a bearing pressure forming area.

As illustrated in FIG. 2, when a bearing length L is shorter than a bearing diameter D, for example, when a ratio of the bearing diameter D to the bearing length L is 10:7.6, there is a high possibility that the bearing is not filled with oil due to an impact of an oil leak occurring above and below the bearing.

A portion of the oil groove 1 is designed to be exposed to the outside of the bearing so that dirt rising from the shaft portion of the crankshaft can easily escape without causing the bearing wear, which may further worsen an oil shortage mentioned above.

It is configured such that the oil is subject to the centrifugal force because the bearing has a distance from the center of the shaft portion at any position, and an end of the bearing is formed in the direction of gravity. This configuration may additionally cause an increase in the oil leakage from a bearing clearance.

According to the present inventor's visual observation, it was found that a large amount of oil actually scattered through the pin connector 3 of the connecting rod.

Therefore, even if it is assumed that the oil is full, the wear reliability of the bearing may actually deteriorate.

As above, according to the crankshaft with an oil supply structure described in FIGS. 1 and 2 and the prior patent, there is a problem in that the oil shortage occurs in the fourth section with high load and the wear reliability of the bearing deteriorates.

PRIOR ART DOCUMENT

[Patent Document]

Prior Patent: CN 203051043U

DISCLOSURE

Technical Problem

An object of the present disclosure is to provide a reciprocating compressor that can be smoothly lubricated by oil in a stroke section with high load.

Another object of the present disclosure is to provide a reciprocating compressor in which an oil groove can improve an oil shortage situation that may occur due to structural characteristics of the bearing being open at the top and bottom.

Another object of the present disclosure is to provide a reciprocating compressor improving the wear reliability of a bearing formed by a pin portion of a crankshaft and a connecting rod.

The technical objects to be achieved by the present disclosure are not limited to those that have been described hereinabove merely by way of example, and other technical objects that are not mentioned can be clearly understood by those skilled in the art, to which the present disclosure pertains, from the following descriptions.

Technical Solution

In a reciprocating compressor according to one aspect of the present disclosure, a crankshaft includes a first oil hole passing through a shaft portion and a pin portion, a second oil hole that is connected to the first oil hole and is formed toward an outer surface of the pin portion, and an oil groove that is formed on the outer surface of the pin portion and is connected to the second oil hole, and the oil groove is configured to supply an oil to a pressurized portion of a bearing immediately before entering a section in which a gas load increases.

According to the above configuration, since the oil is supplied to the pressurized portion of the bearing formed by the pin portion of the crankshaft and a connecting rod immediately before entering a stroke section subjected to a high load, oil outflow to an end of the bearing before the pressurized portion of the bearing meets a gas load increase section is minimized, and the pressurized portion of the bearing passes through the gas load increase section in a situation where a bearing surface is sufficiently wet with the oil.

Accordingly, lubrication by the oil can be smoothly performed in the stroke section subjected to the high load, and oil shortage can be improved even if the oil groove adopts a structure in which the bearing is open at the top and bottom.

Hence, wear reliability of the bearing can be improved.

The pin portion may eccentrically rotate clockwise around the shaft portion while sequentially going through a first section in which the pin portion rotates clockwise until a crank angle, at which the piston is positioned at top dead center, reaches from 0° to 90°, a second section in which the pin portion rotates clockwise until the crank angle reaches from 90° to 180°, a third section in which the pin portion rotates clockwise until the crank angle reaches from 180° to 270°, and a fourth section in which the pin portion rotates clockwise until the crank angle reaches from 270° to 0°.

In this case, since the section in which the gas load increases is the fourth section, the oil groove may supply the oil to the bearing in a stroke section immediately before the crank angle reaches 270°.

When viewing the pin portion from a side of the piston at the crank angle of 0°, the oil groove may be formed on a left outer surface of the pin portion, and the second oil hole may be formed inside a right side of the pin portion that is an opposite side of the oil groove.

The reciprocating compressor may further comprise a connection groove formed on the outer surface of the pin portion and configured to connect an end of the second oil hole to the oil groove.

When a bearing angle is 0° at the crank angle of 0°, and the bearing angle changes up to 360° in a counterclockwise direction which is an opposite direction of the crank angle, a first end of the oil groove connected to the connection groove is positioned in the second section in which the bearing angle is between 180° and 270°, and a second end positioned opposite the first end of the oil groove is positioned in the first section in which the bearing angle does not exceed 300°.

For example, the first end of the oil groove may be positioned at a lower portion of the bearing, and the oil groove may be formed rightward and upward so that the second end is positioned higher than the first end.

As another example, the first end of the oil groove may be positioned at an upper portion of the bearing, and the oil groove may be formed rightward and downward so that the second end is positioned lower than the first end.

As another example, the first end of the oil groove may be positioned at a mid-height portion of the bearing, and each of first ends of two oil grooves may be connected to the connection groove. One of the two oil grooves may be formed rightward and upward, and the other oil groove may be formed rightward and downward.

An outlet of the first oil hole may be inclined at an inclination angle of 5° or less with respect to an inlet of the first oil hole, and an outlet of the second oil hole may be inclined at an inclination angle of 4° or less with respect to an inlet of the second oil hole.

Advantageous Effects

According to a reciprocating compressor of the present disclosure, since oil is supplied to a pressurized portion of a bearing formed by a pin portion of a crankshaft and a connecting rod immediately before entering a stroke section subjected to a high load, oil outflow to an end of the bearing before the pressurized portion of the bearing meets a gas load increase section is minimized, and the pressurized portion of the bearing passes through the gas load increase section in a situation where a bearing surface is sufficiently wet with the oil.

Accordingly, lubrication by the oil can be smoothly performed in the stroke section subjected to the high load, and oil shortage can be improved even if the oil groove adopts a structure in which the bearing is open at the top and bottom.

Hence, wear reliability of the bearing can be improved.

Effects that could be achieved with the present disclosure are not limited to those that have been described hereinabove merely by way of example, and other effects and advantages of the present disclosure will be more clearly understood from the following description by a person skilled in the art to which the present disclosure pertains.

DESCRIPTION OF DRAWINGS

The accompanying drawings, which are included to provide a further understanding of the present disclosure and constitute a part of the detailed description, illustrate embodiments of the present disclosure and serve to explain technical features of the present disclosure together with the description.

FIG. 1 illustrates a pin portion of a crankshaft for describing an oil supply structure according to a related art when a crank angle is 180°.

FIG. 2 illustrates a location of an oil groove based on a crank angle in a crankshaft according to a related art.

FIG. 3 schematically illustrates configuration of a reciprocating compressor to which a crankshaft with an oil supply structure described in the present disclosure is applicable.

FIG. 4 illustrates an oil supply structure of a crankshaft according to a first embodiment of the present disclosure.

FIG. 5 illustrates a formation location of an oil groove based on a bearing angle in the crankshaft of FIG. 4.

FIG. 6 illustrates configuration of a first oil hole included in the crankshaft of FIG. 4.

FIG. 7 illustrates configuration of a second oil hole included in the crankshaft of FIG. 4.

FIG. 8 illustrates a location of an oil groove based on a crank angle in the crankshaft of FIG. 4.

FIG. 9 is a graph illustrating a minimum oil film thickness based on a crank angle in the crankshaft of FIG. 4.

FIG. 10 illustrates an oil supply structure of a crankshaft according to a second embodiment of the present disclosure.

FIG. 11 illustrates a crank pin portion of the crankshaft of FIG. 10 when a crank angle is 180°.

FIG. 12 illustrates a crank pin portion of the crankshaft of FIG. 10 when a crank angle is 0°.

FIG. 13 illustrates an oil supply structure of a crankshaft according to a third embodiment of the present disclosure.

FIG. 14 illustrates a crank pin portion of the crankshaft of FIG. 13 when a crank angle is 180°.

FIG. 15 illustrates a crank pin portion of the crankshaft of FIG. 13 when a crank angle is 0°.

FIG. 16 illustrates an oil supply structure of a crankshaft according to a fourth embodiment of the present disclosure.

FIG. 17 illustrates a crank pin portion of the crankshaft of FIG. 16 when a crank angle is 180°.

FIG. 18 illustrates a crank pin portion of the crankshaft of FIG. 16 when a crank angle is 0°.

MODE FOR INVENTION

Reference will now be made in detail to embodiments of the present disclosure, examples of which are illustrated in the accompanying drawings. Wherever possible, the same reference numbers will be used throughout the drawings to refer to the same or like parts.

In general, a suffix such as "assembly" and "unit" may be used to refer to elements or components. Use of such a suffix herein is merely intended to facilitate description of the present disclosure, and the suffix itself is not intended to give any special meaning or function.

It will be noted that a detailed description of known arts will be omitted if it is determined that the detailed description of the known arts can obscure embodiments of the present disclosure.

The accompanying drawings are used to help easily understand various technical features and it should be understood that embodiments presented herein are not limited by the accompanying drawings. As such, the present disclosure should be understood to extend to any alterations, equivalents and substitutes in addition to those which are particularly set out in the accompanying drawings.

The terms including an ordinal number such as first, second, etc. may be used to describe various components, but the components are not limited by such terms. The terms are used only for the purpose of distinguishing one component from other components.

When any component is described as "being coupled" or "being assembled" to other component, this should be understood to mean that another component may exist between them although any component may be directly coupled or assembled to the other component.

On the other hand, when any component is described as "being directly coupled" or "being directly assembled" to other component, this should be understood to mean that no component exists between them.

A singular expression can include a plural expression as long as it does not have an apparently different meaning in context.

In the present disclosure, terms "include" or "have" should be understood to be intended to designate that illustrated features, numbers, steps, operations, components, parts or combinations thereof are present and not to preclude the existence of one or more other features, numbers, steps, operations, components, parts or combinations thereof, or the possibility of the addition thereof.

Reference will now be made in detail to embodiments of the present disclosure, examples of which are illustrated in the accompanying drawings. Wherever possible, the same reference numbers will be used throughout the drawings to refer to the same or like parts.

FIG. 3 schematically illustrates configuration of a reciprocating compressor to which a crankshaft described in the present disclosure is applicable.

The reciprocating compressor includes a sealed container 10 with a sealed space, an electric drive unit 100 installed in the sealed container 10, and a compression unit 200 that is installed on an upper side of the electric drive unit 100 to receive a rotational force of the electric drive unit 100 and compress a refrigerant.

The electric drive unit 100 and the compression unit 200 are fixed to an inner space of the sealed container 10 and are supported by a cylinder block 20 on which a cylinder 210 to be described later is formed.

The electric drive unit 100 may apply a constant speed motor or an inverter motor capable of a forward rotation and a reverse rotation.

The electric drive unit 100 includes a stator 110 that is supported by a support spring 141 fixed to the cylinder block 20 and a bottom surface of the sealed container 10 and is installed elastically, and a rotor 120 rotatably installed inside the stator 110.

The compression unit 200 includes a crankshaft 290. The crankshaft 290 includes a shaft portion 291 that is coupled to the rotor 120 and is inserted into the cylinder block 20, an eccentric mass portion 293 that is eccentrically formed in a fan shape or an eccentric circular flange shape at an upper end of the shaft portion 291 to form a plate-shaped extension, and a pin portion 295 which is formed eccentrically with respect to the shaft portion 291 at an upper surface of the eccentric mass portion 293 and eccentrically rotates around the shaft portion 291.

The compression unit 200 includes the cylinder 210 forming a predetermined compression space V1, a piston 220 that compresses the refrigerant while making a linear reciprocating motion in the compression space V1 of the cylinder 210, a connecting rod 230 that includes an end rotatably coupled to the piston 220 and another end rotatably coupled to the pin portion 295 of the crankshaft 290 and converts a rotational motion of the electric drive unit 100 into a linear motion of the piston 220, a valve assembly 250 that is coupled to a tip of the cylinder 210 and an end surface corresponding to a head surface of the piston 220 and includes an intake valve and a discharge valve, an intake muffler 260 coupled to an intake side of the valve assembly 250, a discharge cover 270 coupled to accommodate a discharge side of the valve assembly 250, and a discharge muffler 280 that communicates with the discharge cover 270 and attenuates a discharge noise of the discharged refrigerant.

The cylinder 210 is formed horizontally in a cylindrical shape and is formed integrally with or assembled with the cylinder block 20.

The cylinder 210 is formed with both ends open. The valve assembly 250 is fixed to an opening at one end of the cylinder 210, and an opening at the other end of the cylinder 210 is sealed by the piston 220 to form the compression space V1.

The piston 220 is formed in a cylindrical shape with one end closed. The piston 220 is rotatably pin-coupled to a piston connector 233 formed at one end of the connecting rod 230.

The connecting rod 230 is made of a sintered alloy material. The connecting rod 230 includes a pin connector 231 rotatably coupled to an outer peripheral surface of the pin portion 295, a rod portion 232 extending from the pin connector 231, and the piston connector 233 that is formed at other end of the rod portion 232 and is rotatably coupled to the piston 220.

An oil supply structure of a crankshaft according to a first embodiment of the present disclosure is described below with reference to FIGS. 4 to 8.

FIG. 4 illustrates an oil supply structure of a crankshaft according to a first embodiment of the present disclosure. FIG. 5 illustrates a formation location of an oil groove based on a bearing angle in the crankshaft of FIG. 4.

FIG. 6 illustrates configuration of a first oil hole included in the crankshaft of FIG. 4. FIG. 7 illustrates configuration of a second oil hole included in the crankshaft of FIG. 4. FIG. 8 illustrates a location of an oil groove based on a crank angle in the crankshaft of FIG. 4.

The crankshaft 290 according to the first embodiment of the present disclosure includes a first oil hole OH1 penetrating the shaft portion 291, the eccentric mass portion 293, and the pin portion 295, a second oil hole OH2 that is connected to the first oil hole OH1 and is formed toward an outer surface of the pin portion 295, and an oil groove OG that is formed on the outer surface of the pin portion 295 and is connected to the second oil hole OH2. The oil groove OG supplies oil to a pressurized portion of a bearing formed by the pin portion 295 and the pin connector 231 of the connecting rod 230 immediately before entering a section in which a gas load increases.

The following describes that the bearing is formed by the pin portion 295 and the pin connector 231 of the connecting rod 230, by way of example. However, a sleeve 240 serving as the bearing may be inserted between the pin portion 295 of the crankshaft 290 and the pin connector 231 of the connecting rod 230.

The pin portion 295 eccentrically rotates clockwise around the shaft portion 291 while sequentially going through a first section in which the pin portion 295 rotates clockwise in a state where the piston 220 is positioned at top dead center, that is, until a crank angle reaches from 0° to 90°, a second section in which the pin portion 295 rotates clockwise until the crank angle reaches from 90° to 180°, a third section in which the pin portion 295 rotates clockwise until the crank angle reaches from 180° to 270°, and a fourth section in which the pin portion 295 rotates clockwise until the crank angle reaches from 270° to 0°.

Among the first to fourth sections, the section in which the gas load increases is the fourth section.

The oil groove OG supplies oil to the bearing in the third section immediately before the crank angle reaches 270°.

To this end, when viewing the pin portion 295 from the side of the piston 220 at the crank angle of 0°, the oil groove OG is formed on a left outer surface of the pin portion 295.

That is, in the existing crankshaft illustrated in FIGS. 1 and 2, when viewing the pin portion from the side of the piston at the crank angle of 0°, the oil groove OG is formed on a right outer surface of the pin portion. However, in the crankshaft 290 according to the first embodiment of the present disclosure, the oil groove OG is formed at a location opposite to the existing one.

In addition, when viewing the pin portion 295 from the side of the piston 220 at the crank angle of 0°, the second oil hole OH2 extends from the first oil hole OH1 toward the side where the oil groove OG is formed.

When a bearing angle is 0° at the crank angle of 0°, and the bearing angle changes up to 360° in a counterclockwise direction which is the opposite direction of the crank angle, a first end of the oil groove OG connected to the second oil hole OH2 is preferably positioned in a section in which the bearing angle is between 180° and 270°, that is, the second section in which the crank angle is between 90° and 180°, and a second end positioned opposite the first end of the oil groove OG is preferably positioned in a section in which the bearing angle does not exceed 300°, that is, the first section in which the crank angle is between 0° and 90°.

A reason for limiting the locations of the first end and the second end of the oil groove OG to the range described above is that the concept of oil supply fades if the first end of the oil groove OG is positioned in a section in which the bearing angle is less than 180°, for example, in the third section in which the crank angle is between 180° and 270°, and the pressurized portion of the bearing is excessively invaded if the second end of the oil groove OG is positioned in a section in which the bearing angle exceeds 300°, for example, in the first section in which the crank angle is between 0° and 90°. Hence, a minimum oil film thickness is below 80% of the existing level, adversely affecting the wear reliability.

The first end of the oil groove OG may be positioned at a lower portion of the bearing, and the oil groove OG may be formed rightward and upward so that the second end is positioned higher than the first end.

In order to ensure the smooth oil flow, a centrifugal force of the oil at an outlet of each of the first oil hole OH1 and the second oil hole OH2 needs to be equal to or greater than a centrifugal force of the oil at an inlet.

To this end, the outlet of the first oil hole OH1 is preferably formed to be inclined at an inclination angle A1 of 5° or less with respect to the inlet of the first oil hole OH1, and the outlet of the second oil hole OH2 is preferably formed to be inclined at an inclination angle A2 of 4° or less with respect to the inlet of the second oil hole OH2.

A spiral passage 297 is formed on an outer peripheral surface of the shaft portion 291, and an oil passage 299 is axially formed inside a lower end of the shaft portion 291.

The spiral passage 297 and the oil passage 299 communicate with each other.

An oil feeder 143 is provided at the lower end of the shaft portion 291 to pump oil stored at the bottom of the sealed container 10 into the oil passage 299.

Therefore, the oil pumped into the oil passage 299 by the oil feeder 143 is supplied to the bearing through the oil passage 299, the spiral passage 297, the first oil hole OH1, the second oil hole OH2, and the oil groove OG by the rotation of the shaft portion 291.

Although not specifically described, the oil pumped into the oil passage 299 by the oil feeder 143 may also be supplied to other components requiring the lubrication.

According to the crankshaft 290 with the above-described configuration, the oil groove OG supplies the oil to the bearing in a stroke section immediately before entering the section in which the gas load increases, for example, immediately before the crank angle reaches 270°.

Since the oil is supplied to the pressurized portion of the bearing formed by the pin portion 295 of the crankshaft 290 and the pin connector 231 of the connecting rod 230 immediately before entering a stroke section subjected to a high load, oil outflow to the end of the bearing before the pressurized portion of the bearing meets the gas load increase section is minimized, and the pressurized portion of the bearing passes through the gas load increase section in a situation where a bearing surface is sufficiently wet with oil.

Hence, lubrication by the oil can be smoothly performed in the stroke section subjected to the high load, and the oil shortage can be improved even if the oil groove OG adopts a structure in which the bearing is open at the top and bottom. In addition, the wear reliability of the bearing can be improved.

Further, referring to FIG. 9, the overall oil film thickness of the crankshaft 290 according to the first embodiment of the present disclosure can be improved compared to the crankshaft with the existing structure during a low-speed operation, and a minimum oil film thickness (about 0.9 μm) of the existing structure can be secured even during a high-speed operation.

An oil supply structure of a crankshaft according to a second embodiment of the present disclosure is described below with reference to FIGS. 10 to 12.

In describing the following embodiments, the same reference numerals are given to the same components as those of the crankshaft according to the above-described first embodiment, and detailed descriptions thereof are omitted.

FIG. 10 illustrates an oil supply structure of a crankshaft according to a second embodiment of the present disclosure. FIG. 11 illustrates a crank pin portion of the crankshaft of FIG. 10 when a crank angle is 180°. FIG. 12 illustrates a crank pin portion of the crankshaft of FIG. 10 when a crank angle is 0°.

In the crankshaft 290 according to the first embodiment described above, because the oil groove OG is formed in the opposite direction to the crankshaft of the existing structure, the second oil hole OH2 connecting the first oil hole OH1 to the oil groove OG is also formed to extend in the opposite direction to the crankshaft of the existing structure.

Therefore, unlike the crankshaft 290 according to the first embodiment described above, if the first oil hole OH1 and the second oil hole OH2 are formed in the same manner as the oil supply structure of the crankshaft with the existing structure, a design freedom of the oil supply structure can also be improved.

More specifically, in a crankshaft 290-A according to the second embodiment, when viewing a pin portion 295-A from a side of a piston at a crank angle of 0°, a second oil hole OH2-A is formed inside a right side of the pin portion 295-A that is an opposite side of an oil groove OG.

A connection groove CG is further formed on an outer surface of the pin portion 295-A to connect an end of the second oil hole OH2-A to the oil groove OG.

In the crankshaft 290-A according to the second embodiment, a first end of the oil groove OG connected to the connection groove CG is preferably positioned in a second section in which a bearing angle is between 180° and 270°, and a second end positioned opposite the first end of the oil groove OG is preferably positioned in a first section in which the bearing angle does not exceed 300°.

The first end of the oil groove OG may be positioned at a lower portion of the bearing, and the oil groove OG may be formed rightward and upward so that the second end is positioned higher than the first end.

An oil supply structure of a crankshaft according to a third embodiment of the present disclosure is described below with reference to FIGS. 13 to 15.

FIG. 13 illustrates an oil supply structure of a crankshaft according to a third embodiment of the present disclosure. FIG. 14 illustrates a crank pin portion of the crankshaft of FIG. 13 when a crank angle is 180°. FIG. 15 illustrates a crank pin portion of the crankshaft of FIG. 13 when a crank angle is 0°.

In the third embodiment, a first end of an oil groove OG-B formed on an outer surface of a pin portion 295-B of a crankshaft 290-B is positioned at an upper portion of a bearing, and the oil groove OG-B is formed rightward and downward so that a second end is positioned lower than the first end.

A connection groove CG-B connecting a second oil hole OH2-A to the oil groove OG-B is formed to be inclined upward toward the first end of the oil groove OG-B. Then, the connection groove CG-B extends in parallel at the same height as the first end of the oil groove OG-B and is connected to the first end of the oil groove OG-B.

In the crankshaft 290-B according to the third embodiment, the first end of the oil groove OG-B connected to the connection groove CG-B is preferably positioned in a second section in which a bearing angle is between 180° and 270°, and a second end positioned opposite the first end of the oil groove OG-B is preferably positioned in a first section in which the bearing angle does not exceed 300°.

The crankshaft 290-B with the above oil supply structure has an effect of minimizing an oil leak in the direction of gravity in a process of sending the oil to the oil groove OG-B.

An oil supply structure of a crankshaft according to a fourth embodiment of the present disclosure is described below with reference to FIGS. 16 to 18.

FIG. 16 illustrates an oil supply structure of a crankshaft according to a fourth embodiment of the present disclosure. FIG. 17 illustrates a crank pin portion of the crankshaft of FIG. 16 when a crank angle is 180°. FIG. 18 illustrates a crank pin portion of the crankshaft of FIG. 16 when a crank angle is 0°.

In the fourth embodiment, a first end of an oil groove OG-C formed on an outer surface of a pin portion 295-C of a crankshaft 290-C is positioned at a mid-height portion of a bearing, and the first ends of the two oil grooves OG-C are connected to a connection groove CG-C.

The connection groove CG-C connecting a second oil hole OH2-A to the oil groove OG-C is formed to be inclined upward toward the first end of the oil groove OG-C. Then, the connection groove CG-C extends in parallel at the same height as the first end of the oil groove OG-C and is connected to the first end of the oil groove OG-C.

One of the two oil grooves OG-C is formed rightward and upward, and the other oil groove OG-C is formed rightward and downward.

In the crankshaft 290-C according to the fourth embodiment, the first end of the oil groove OG-C connected to the connection groove CG-C is preferably positioned in a second section in which a bearing angle is between 180° and 270°, and a second end positioned opposite the first end of the oil groove OG-C is preferably positioned in a first section in which the bearing angle does not exceed 300°.

The crankshaft 290-C with the above oil supply structure has an effect of reducing an oil leak in the direction of gravity in a process of sending the oil to the oil groove OG-C and an effect of reducing interference with a pressurized portion of the oil groove OG-C as much as possible by minimizing a width of the oil groove OG-C.

It is apparent to those skilled in the art that the present disclosure can be embodied in other specific forms without departing from essential features of the present disclosure. Accordingly, the above detailed description should not be construed as limiting in all aspects and should be considered as illustrative. The scope of the present disclosure should be determined by rational construing of the appended claims, and all modifications within an equivalent scope of the present disclosure are included in the scope of the present disclosure.

The invention claimed is:

1. A reciprocating compressor, comprising:

a sealed container with a sealed space;

an electric drive unit installed in the sealed container and configured to generate a rotational force; and a compression unit installed on an upper side of the electric drive unit and configured to receive the rotational force of the electric drive unit and compress a refrigerant, wherein the compression unit includes:

a crankshaft including a shaft portion that is coupled to a rotor and is inserted into a cylinder block, an eccentric mass portion that is eccentrically formed in a fan shape or an eccentric circular flange shape at an upper end of the shaft portion to form a plate-shaped extension, and a pin portion which is formed eccentrically with respect to the shaft portion at an upper surface of the eccentric mass portion and eccentrically rotates around the shaft portion;

a connecting rod rotatably coupled to the pin portion and configured to convert a rotational motion into a linear motion; and a piston rotatably coupled to the connecting rod and configured to compress the refrigerant while linearly reciprocating in a cylinder, wherein the crankshaft further includes a first oil hole passing through the shaft portion and the pin portion, a second oil hole that is connected to the first oil hole and formed toward an outer surface of the pin portion, and an oil groove that is formed on the outer surface of the pin portion and connected to the second oil hole, wherein the oil groove supplies oil to a pressurized portion of a bearing formed by the pin portion and the connecting rod immediately before entering a section in which a gas load increases, wherein the pin portion eccentrically rotates clockwise around the shaft portion while sequentially going through a first section in which the pin portion rotates clockwise until a crank angle, at which the piston is positioned at top dead center, reaches from 0° to 90°, a second section in which the pin portion rotates clockwise until the crank angle reaches from 90° to 180°, a third section in which the pin portion rotates clockwise until the crank angle reaches from 180° to 270°, and a fourth section in which the pin portion rotates clockwise until the crank angle reaches from 270° to 0°, and wherein the section in which the gas load increases is the fourth section.

2. The reciprocating compressor of claim 1, wherein the oil groove supplies the oil to the bearing in the third section immediately before the crank angle reaches 270°.

3. The reciprocating compressor of claim 2, wherein, based on the pin portion being viewed from a side of the piston at the crank angle of 0°, the oil groove is formed on a left outer surface of the pin portion.

4. The reciprocating compressor of claim 3, wherein, based on the pin portion being viewed from the side of the piston at the crank angle of 0°, the second oil hole is formed inside a right side of the pin portion that is an opposite side of the oil groove.

5. The reciprocating compressor of claim 4, further comprising:

a connection groove formed on the outer surface of the pin portion and configured to connect an end of the second oil hole to the oil groove.

6. The reciprocating compressor of claim 5, wherein, based on a bearing angle being 0° at the crank angle of 0°, and the bearing angle changing up to 360° in a counter-clockwise direction which is an opposite direction of the crank angle, a first end of the oil groove connected to the connection groove is positioned in the second section in which the bearing angle is between 180° and 270°, and a second end positioned opposite the first end of the oil groove is positioned in the first section in which the bearing angle does not exceed 300°.

7. The reciprocating compressor of claim 6, wherein the first end of the oil groove is positioned at a lower portion of the bearing.

8. The reciprocating compressor of claim 7, wherein the oil groove is formed rightward and upward so that the second end is positioned higher than the first end.

9. The reciprocating compressor of claim 6, wherein the first end of the oil groove is positioned at an upper portion of the bearing.

10. The reciprocating compressor of claim 9, wherein the oil groove is formed rightward and downward so that the second end is positioned lower than the first end.

11. The reciprocating compressor of claim 6, wherein the first end of the oil groove is positioned at a mid-height portion of the bearing.

12. The reciprocating compressor of claim 11, wherein each of first ends of two oil grooves is connected to the connection groove, and wherein one of the two oil grooves is formed rightward and upward, and the other oil groove is formed rightward and downward.

13. The reciprocating compressor of claim 7, wherein an outlet of the first oil hole is inclined at an inclination angle of 5° or less with respect to an inlet of the first oil hole.

14. The reciprocating compressor of claim 13, wherein an outlet of the second oil hole is inclined at an inclination angle of 4° or less with respect to an inlet of the second oil hole.

15. The reciprocating compressor of claim 9, wherein an outlet of the first oil hole is inclined at an inclination angle of 5° or less with respect to an inlet of the first oil hole.

16. The reciprocating compressor of claim 15, wherein an outlet of the second oil hole is inclined at an inclination angle of 4° or less with respect to an inlet of the second oil hole.

17. The reciprocating compressor of claim 11, wherein an outlet of the first oil hole is inclined at an inclination angle of 5° or less with respect to an inlet of the first oil hole.

18. The reciprocating compressor of claim 17, wherein an outlet of the second oil hole is inclined at an inclination angle of 4° or less with respect to an inlet of the second oil hole.

* * * * *